US009533745B2

(12) United States Patent
Bianchi

(10) Patent No.: US 9,533,745 B2
(45) Date of Patent: Jan. 3, 2017

(54) FEATHERING PROPELLER WITH ADJUSTABLE ABUTMENT

(75) Inventor: Massimiliano Bianchi, Milan (IT)

(73) Assignee: MAX PROP S.R.L., Milan (MI) (IT)

( * ) Notice: Subject to any disclaimer, the term of this patent is extended or adjusted under 35 U.S.C. 154(b) by 460 days.

(21) Appl. No.: 14/130,611

(22) PCT Filed: Jul. 18, 2011

(86) PCT No.: PCT/IB2011/001655
§ 371 (c)(1),
(2), (4) Date: Mar. 25, 2014

(87) PCT Pub. No.: WO2013/011338
PCT Pub. Date: Jan. 24, 2013

(65) Prior Publication Data

US 2014/0301843 A1 Oct. 9, 2014

(51) Int. Cl.

| | |
|---|---|
| ***B63H 3/00*** | (2006.01) |
| ***B63H 3/12*** | (2006.01) |
| ***B63H 3/02*** | (2006.01) |

(52) U.S. Cl.
CPC ..... *B63H 3/12* (2013.01); *B63H 3/008* (2013.01); *B63H 3/02* (2013.01); *B63H 2003/004* (2013.01); *Y10T 29/49718* (2015.01)

(58) Field of Classification Search
CPC ..... B63H 3/008; B63H 3/02
(Continued)

(56) References Cited

U.S. PATENT DOCUMENTS 3,253,660 A * 5/1966 Maker ..... B63H 3/02 416/160
3,282,351 A * 11/1966 Troutman ..... B63H 3/02 416/167

(Continued)

FOREIGN PATENT DOCUMENTS

| | | |
|---|---|---|
| DE | 39 01 672 A1 | 8/1990 |
| DE | 40 34 587 A1 | 5/1992 |
| DE | 198 23 884 A1 | 12/1999 |

OTHER PUBLICATIONS

Machine Translation of DE 19823884.*
International Search Report of PCT/IB2011/001655 dated Jun. 21, 2012 and Written Opinion.

*Primary Examiner* — Kevin Murphy
(74) *Attorney, Agent, or Firm* — Lucas & Mercanti, LLP

(57) ABSTRACT

There is described an assembly having a plurality of screws, a propeller and a related method for adjusting the fluid dynamic pitch of the blades of the propeller. The propeller has at least one blade pivoted rotatably to a cylindrical propeller casing, a hub coupled to an engine and mounted coaxially inside the propeller casing, a kinematic mechanism coupled to the hub and/or to the propeller casing, and to the blade for adjusting the fluid dynamic pitch of the propeller. The hub is rotatable with respect to the cylindrical propeller casing, or vice versa, for at least one non-zero angular interval (α) of operation of the kinematic mechanism for adjusting the fluid dynamic pitch and is also integral with a contact surface movable between disengagement from and engagement with, direct or indirect, at least one relative abutment integral with the cylindrical propeller casing which defines a limit stop of the angular interval (α). The plurality of screws has at least two different screws and the propeller has a seat for complete installation of a screw selected from the plurality of screws, and the limit stop
(Continued)

abutment has a region of screw selected from the plurality of screws installed in the seat provided in the propeller.

15 Claims, 3 Drawing Sheets

(58) Field of Classification Search
USPC ..... 192/25, 46, 48.92, 110 R
See application file for complete search history.

(56) References Cited

U.S. PATENT DOCUMENTS

| | | | | | |
|---|---|---|---|---|---|
| 3,912,416 | A * | 10/1975 | Herbert | B63H 3/02 | 416/160 |
| 3,958,897 | A * | 5/1976 | Connolly | B63H 3/02 | 416/166 |
| 4,792,279 | A * | 12/1988 | Bergeron | B63H 3/008 | 416/131 |
| 5,203,675 | A * | 4/1993 | Marini | B63H 3/12 | 416/140 |
| 5,259,589 | A * | 11/1993 | Posner | F16K 5/0647 | 251/285 |
| 5,445,497 | A * | 8/1995 | Seemar | B63H 3/008 | 416/131 |
| 5,466,177 | A * | 11/1995 | Aihara | B63H 3/008 | 416/89 |
| 6,189,666 | B1 * | 2/2001 | Willmot | F16D 41/00 | 192/46 |
| 2010/0040469 | A1 * | 2/2010 | Bianchi | B63H 3/02 | 416/134 R |

* cited by examiner

FEATHERING PROPELLER WITH ADJUSTABLE ABUTMENT

CROSS-REFERENCE TO RELATED APPLICATION

This application is a 371 of PCT/IB2011/001655, filed Jul. 18, 2011, which claims the contents of which are incorporated herein by reference.

FIELD OF THE INVENTION

The present invention relates to an assembly comprising a plurality of screws and a propeller, preferably for nautical use, and a related method, for adjusting the fluid dynamic pitch of the propeller blades.

BACKGROUND ART

It is known that positioning of the propeller blades with a correct and suitable angle of incidence with respect to the fluid that strikes the blades, that is, a correct fluid dynamic pitch, makes it possible, also as a function of the conditions of use and of the torque supplied by the motor of the boat to which the propeller is coupled, to maintain a high output and achieve satisfactory performances of the same propeller.

The Italian patent IT 1 052 002, in the name of Massimiliano Bianchi, relates to the production a propeller, particularly for use in sailing boats, in which the drive shaft (or the relative propeller hub) and the propeller casing are mutually coupled by two coplanar teeth orthogonal to the propeller axis itself.

When the propeller is stationary, the blades are arranged in the feathered position, so as to generate minimum resistance, and the teeth of the hub and of the propeller casing are spaced apart so that the subsequent rotation of the drive shaft and consequently of the hub, both in one direction and in the other, determines idle rotation thereof for a given angular interval, which, due to an appropriate kinematic mechanism with pinion and gear wheels, corresponds to a rotation of the blades with respect to the cylindrical casing.

When the hub reaches the position of abutment against the propeller casing, and their relative rotation is prevented, the blades are positioned according to a predetermined fluid dynamic pitch, which will depend on the angle of relative rotation between the hub and the propeller casing, and vice versa.

In this way, the propeller blades can reach a first pitch, and consequently a given angle of incidence, adapted for forward movement of the boat, and a second pitch, adapted for reverse movement of the boat, depending on the direction of rotation of the drive shaft with respect to the propeller casing.

However, with a propeller of the type described above it is not possible to easily modify the fluid dynamic pitch, or the interval of fluid dynamic pitches, of the propeller established in the design phase.

In fact, once the pitch of the blades most suitable for forward movement and most suitable for reverse movement of the boat has been established in the design phase, it is no longer possible for the operator to easily vary this angle of rotation. Modification of the pitch of the propeller in this case can only take place by disassembling the propeller and performing internal operations either replacing the hub or the propeller casing, or subjecting these elements to machining operations.

Only by performing these operations, the relative rotation of the hub with respect to the propeller casing determines positioning of the blades at the pitch desired according to the requirements of installation and use. Naturally, the user of the propeller is not able to disassemble the propeller, or to replace or machine its parts, and therefore must have this performed by a skilled mechanic or send the propeller to the manufacturer.

To overcome these drawbacks, propellers have been developed in which the angle of relative rotation of the hub with respect to the propeller casing, and vice versa, which results in a rotation of the blades about their pivot axis with respect to the propeller casing by means of a specific kinematic mechanism, can be modified by the user by acting on threaded grub screws which are screwed into specific seats provided in the propeller, in such a manner as to project inside the propeller casing to determine a modification of the angle of relative rotation between the hub and the propeller casing.

A propeller of this type is described in the patent DE3901672, in which the hub has a tooth destined to come into contact with two relative stop abutments provided on the cylindrical propeller casing following idle rotation, for an angular interval of rotation between the propeller casing and the hub, which causes the predetermined fluid dynamic pitch of the blades to be reached.

The propeller casing is provided with two threaded seats, screwed inside which are two grub screws destined to project inside the propeller casing and on which the tooth of the hub is destined to reach the position of abutment. Consequently, the ends of the grub screws projecting inside the propeller casing form the aforesaid stop abutments for the tooth of the hub.

Relative rotation of the hub with respect to the propeller casing, and the fluid dynamic pitch of the blades that is set as a consequence, are modified by the user of the boat by screwing or unscrewing the grub screws in such a manner that the portion thereof that projects inside the propeller casing is increased or decreased, obtaining a corresponding modification of the position of abutment with the tooth of the hub, and therefore a consequent modification of the angular interval of rotation of the hub with respect to the propeller casing, and vice versa.

However, this type of propeller has some drawbacks deriving from the fact that adjustment of the pitch of the blades is obtained in a manner that is not accurate and substantially linked to the ability and precision of the user of the boat during screwing or unscrewing of the grub screws in the corresponding threaded seats for a given number of turns, or fractions of turns, suitable to reach the required pitch.

In fact, when the user of the boat wishes to modify the pitch of the blades he or she must act manually on the grub screws, screwing or unscrewing them inside the threaded seats.

Naturally, this adjustment is somewhat imprecise and the user often makes mistakes in adjusting the grub screws, which result in incorrect positioning of the blades at a different fluid dynamic pitch to the one required. In fact, as already stated, the user must perform a clockwise or counterclockwise rotation of the grub screws for a given number of turns, or fractions of turn.

Added to this is the significant complication caused by the fact that these operations to adjust the grub screws are generally carried out under the surface of the water.

It is clear that a procedure of this kind requires numerous attempts, during which the user is required to go underwater and try various adjustments, unscrewing or screwing the grub screws.

It must also be noted that in the case in which the new fluid dynamic pitch set is not satisfactory in terms of efficiency and performance with respect to the one previously set, the user must try to remember the direction and degree of rotation of the grub screws, trying to return them to the previous position, in order to restore the previously set fluid dynamic pitch.

Therefore, it is necessary to simplify the adjustment operations described above, reducing the number of attempts that the user of the boat must carry out to obtain the required fluid dynamic pitch.

The object of the present invention is therefore to overcome the problems of prior art discussed briefly above, and to provide an assembly and related method for adjusting the fluid dynamic pitch of the blades which is simple to perform and, above all, ensures that the fluid dynamic pitch required is accurately set.

The object of the present invention is also to provide an assembly and a method for adjusting the fluid dynamic pitch thanks to which the user of the boat can position the blades at different fluid dynamic pitches without having to make numerous attempts at adjustment.

SUMMARY OF THE INVENTION

These and other objects are achieved by an assembly and related method of use, respectively according to the independent claims 1 and 14.

The assembly according to the present invention comprises a plurality of screws and a propeller provided with at least one blade pivoted rotatably to a cylindrical propeller casing, a hub coupled to an engine and mounted coaxially inside the propeller casing, a kinematic mechanism coupled to the hub and/or to the propeller casing, and to said at least one blade for adjusting the fluid dynamic pitch of the propeller by means of rotation of at least one blade about its pivot axis to the propeller casing. The hub is rotatable with respect to the cylindrical propeller casing, or vice versa, for at least one non-zero angular interval ($\alpha$) of operation of the kinematic mechanism for adjusting the fluid dynamic pitch, and the hub is also integral with at least one contact surface movable between at least one position of disengagement from and at least one position of engagement with, direct or indirect, at least one relative abutment integral with the cylindrical propeller casing which defines at least one limit stop of the angular interval ($\alpha$).

The assembly is characterized in that the plurality of screws comprises at least two different screws and in that the propeller comprises at least one seat for complete installation of at least one screw selected from the plurality of screws, and in that the at least one limit stop abutment comprises at least one region of at least one screw selected from the plurality of screws and installed completely in said seat provided in the propeller. According to a preferred embodiment, the region of the screw that acts as limit stop abutment of the angular interval ($\alpha$) comprises at least the end of the screw.

Advantageously, the user of the assembly according to the present invention is provided with a plurality of screws, having different configuration, adapted to be installed alternatively, depending on the fluid dynamic pitch of the blades required to be set, in the specific seat provided in the propeller. The limit stop abutment of the angle of rotation of the hub with respect to the cylindrical propeller casing, which as stated determines the modification of the fluid dynamic pitch, comprises a region, and preferably the end of the screw installed completely in the specific seat provided in the propeller.

Advantageously, according to the length of the screw installed, it is possible to obtain a modification of the angular interval of relative rotation of the hub with respect to the propeller casing, and in particular a modification of the limit stop of this angular interval.

In fact, according to the length of the screw installed, the at least one contact surface integral with the hub will reach the position of engagement with the relative abutment, that is, a region of the screw, and preferable the end thereof, following the rotation with respect to the cylindrical propeller casing, or vice versa, in an angular interval of different dimensions in relation to the modification of the limit stop of this angular interval by means of the length of the screw.

In this manner, the problems present in prior art propellers, such as the one described in DE3901672, in which the pitch of the blades is modified by making various attempts to adjust the grub screws, are eliminated.

According to one aspect of the present invention, each screw has at least one stem having a different length with respect to that of the other screws, and according to a further possible embodiment the plurality of screws comprises pairs of screws having a stem of identical length, and each pair has a stem of different length with respect to that of the other pairs of screws.

The user will therefore be provided with a plurality of screws having different lengths to allow accurate adjustment of the fluid dynamic pitch of the blades by installing the screw in the specific seat and determining a modification of the limit stop of the angular interval of rotation of the hub with respect to the cylindrical casing, and vice versa, in relation to the length of the screw.

It must be noted that a given fluid dynamic pitch of the blades corresponds to each stem length of the screw; therefore, by selecting the screw from the plurality of screws provided, the user has the certainty of setting the required fluid dynamic pitch corresponding to the length of the screw installed.

The screws are installed completely, by complete screwing, inside the specific seat provided in the propeller. With the expression "installed completely" it is intended that the screws reach a position of contact with at least one abutment portion provided in the seat in which they are installed. In this way, the user inserts the screw and screws it down completely inside the seat until reaching the position of contact with the abutment portion of the seat, in such a manner that the screw reaches a certain and unequivocal position inside the seat and which can therefore determine the modification of the limit stop of the angular interval of rotation of the predetermined amplitude.

It must be noted that the term "screw" is used here and hereinafter to indicate any element provided with at least one stem having a predetermined length and provided with at least one portion, or one head, adapted to reach at least one position of contact with at least one abutment portion of the seat inside which the screw is installed.

According to a possible embodiment, each screw is provided with at least one portion, or one head bearing a thread capable of cooperating with a corresponding threaded portion of the seat provided in the propeller, and in which the screw is installed.

According to one aspect of the present invention, the hub of the propeller is provided with a first and with a second contact surface, adapted to reach a first position of engagement, direct or indirect, with a relative first limit stop abutment, integral with the cylindrical propeller casing, and a second position of engagement, direct or indirect, of the second contact surface with a relative second limit stop abutment, integral with the cylindrical propeller casing. In this case, the angular interval of rotation (α) of the hub with respect to the cylindrical propeller casing is defined by the first and by the second position of engagement. Preferably, the propeller according to the embodiment described above comprises two seats for installation, inside each of these seats, of at least one screw selected by the user from the plurality of screws provided.

In this way, it is possible to separately adjust the fluid dynamic pitch of the blades in the case in which the hub is operated by the drive shaft in clockwise or in counter-clockwise direction, generally used to allow navigation in forward drive and in reverse drive.

In fact, the possibility of installing two screws separately in the specific seats for modification of the limit stop, respectively for rotation of the hub in the two rotation directions, allows the fluid dynamic pitch of the blades for the two navigation modes to be adjusted with certainty in a completely separate and accurate manner.

The possibility of certain adjustment of the fluid dynamic pitch of the blades in the two navigation directions, forward drive and reverse drive, following rotation of the hub with respect to the propeller casing in clockwise or counter-clockwise direction, and vice versa, is particularly advantageous in the case in which the blades of the propeller are provided with symmetrical profile and therefore require to be positioned at the same fluid dynamic pitch both for navigation in forward drive and in reverse drive. In this regard, the assembly according to the present invention allows screws of identical length to be installed in the two seats in the propeller, in such a manner to be able to set, in an extremely accurate manner, the pitch of the blades for both directions of rotation of the hub with respect to the cylindrical casing, and vice versa, due to identical modification of the limit stop of the angular interval.

According to a possible embodiment, the assembly also comprises a plurality of calibrated rods which can be inserted alternatively between the at least one contact surface of the hub and the relative abutment integral with the cylindrical casing, inside the angular interval of relative rotation (α) of the hub with respect to the cylindrical propeller casing, or vice versa, to perform adjustment thereof.

Naturally, depending on the thickness (dimension) of the rod or rods installed, it is possible to vary in a different manner the angular interval of rotation, allowing a different modification of the fluid dynamic pitch of the blades.

There is also described a method for adjusting the fluid dynamic pitch of the blades of a propeller by means of an assembly briefly described above, characterized in that it comprises a step of selecting, from the plurality of screws, at least one screw configured to define a required angular interval of relative rotation (α) of the hub with respect to the cylindrical propeller casing, or vice versa; a subsequent step of installing the screw selected in the corresponding seat provided in the propeller; and a further step of replacing the screw installed in the seat with a different screw selected from the plurality of screws provided, when it is necessary to modify the angular interval (α) of relative rotation of the hub with respect to the cylindrical propeller casing, or vice versa.

The method for adjusting the pitch is therefore much simpler and guarantees positioning of the blades at the pre-selected pitch, without it being necessary to carry out a procedure comprising a series of attempts and tries, as occurs in prior art propellers, and in particular for adjusting the propeller described in DE3901672.

The same operations described above in relation to the plurality of screws with which the user of the propeller is provided, can be carried out to modify the pitch of the blades by means of selecting and installing one or more rods inside the angular interval between the at least one contact surface of the hub and the relative limit stop abutment, integral with the cylindrical propeller casing.

BRIEF DESCRIPTION OF THE FIGURES

Further characteristics and advantages of the present invention will be more apparent from the following description, provided by way of example with reference to the accompanying figures, wherein.

DETAILED DESCRIPTION OF SOME EMBODIMENTS OF THE PRESENT INVENTION

Figure 1:
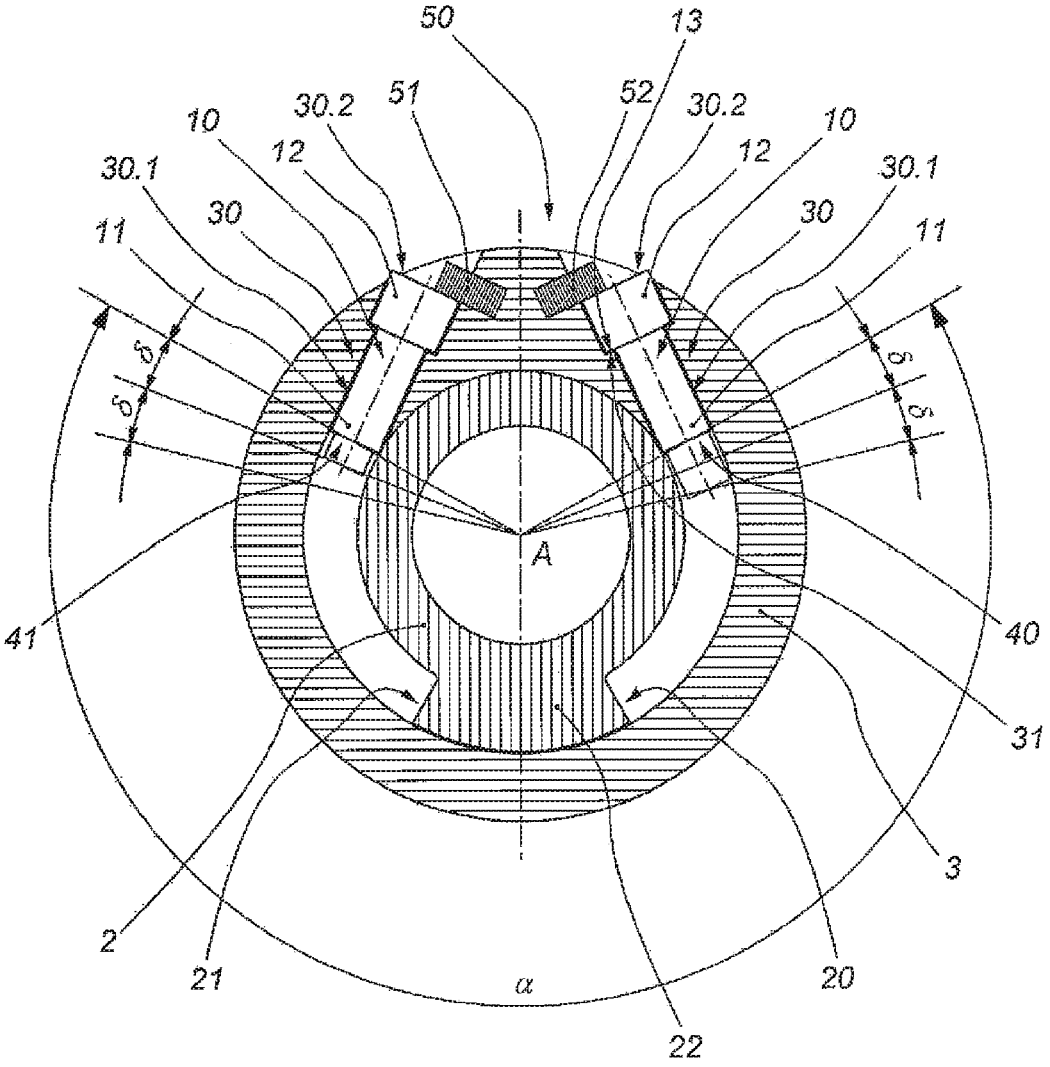
FIG. 1 shows a sectional view according to a plane perpendicular to the hub, of a propeller in which two screws selected from the plurality of screws are installed, according to a possible embodiment of the assembly according to the present invention.
Figure 2:
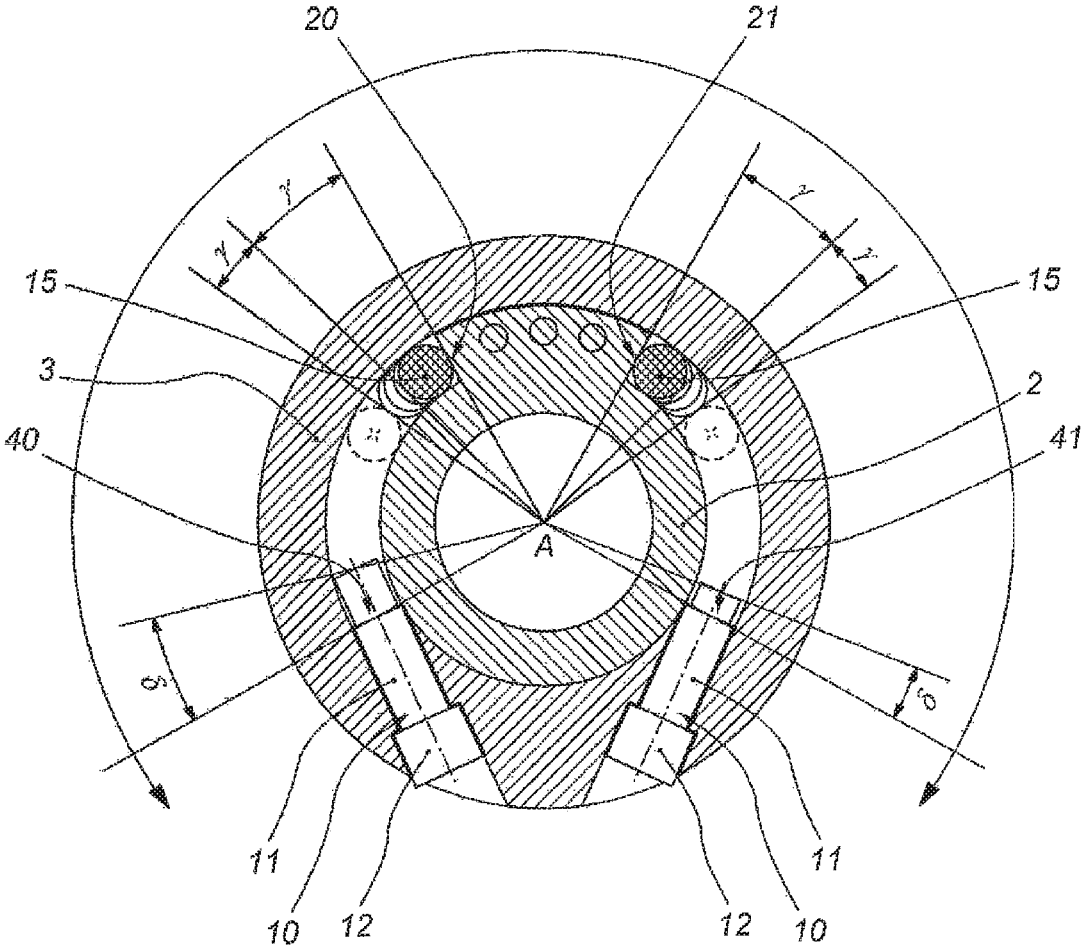
FIG. 2 shows a sectional view according to a plane perpendicular to the hub, of a propeller according to FIG. 1, in which two calibrated rods and two calibrated screws are installed, according to a possible embodiment of the assembly according to the present invention.

FIGS. 1-2 show a possible embodiment of the assembly according to the present invention, comprising a plurality of screws and a propeller, preferably for nautical use, in which one or more screws selected from the plurality of screws provided are installed, to modify the fluid dynamic pitch of the blades by means of modification of the angle of relative rotation between the hub 2 and the cylindrical propeller casing 3.

Similarly to the propeller described in the document IT1052002, in the name of Massimiliano Bianchi, the propeller of the assembly according to the present invention comprises a hollow cylindrical casing 3 and a drive shaft operated by an engine, not shown in the figures.

The drive shaft is constrained according to known means to a hub 2, or this latter can form an end of the same drive shaft.

The propeller hub 2 is coupled coaxially to the cylindrical casing 3 in such a manner as to allow, as will be described in more detail below, transmission of the rotary motion from the drive shaft to the cylindrical casing.

Figure 3:
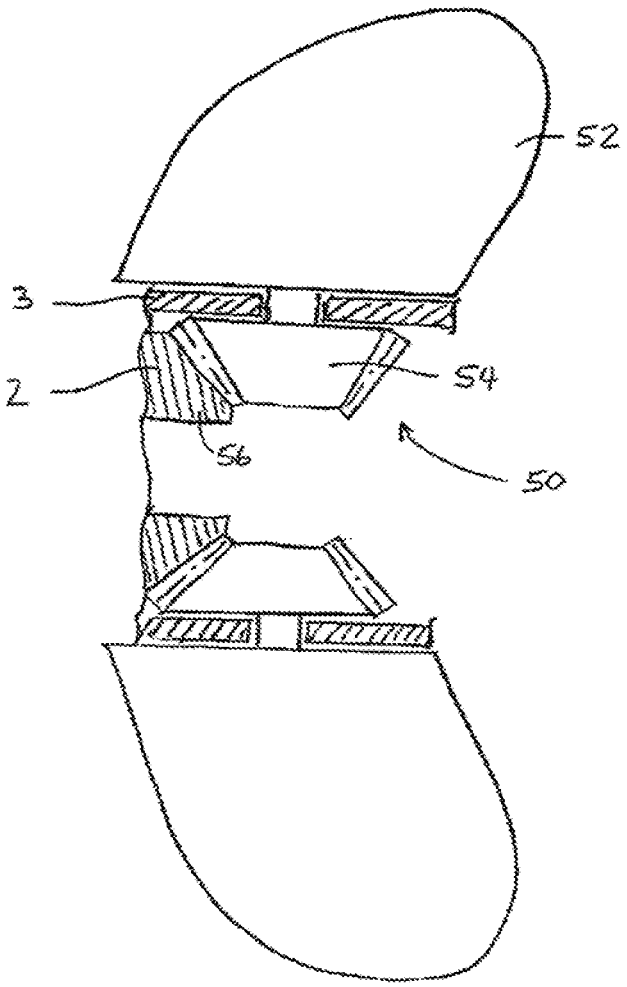
FIG. 3 shows a schematic partial sectional view of an embodiment of a kinematic mechanism used by the present invention.

As shown in FIG. 3, the propeller blades 52 are pivoted to the propeller casing 3 in a manner such that they can rotate about their pivot axis; in other words, the blades 52 can rotate along an axis orthogonal with respect to the axis defined by the hub 2 of the propeller, which coincides with the direction of motion of the propeller during forward and reverse drive.

The propeller according to the present invention also comprises a kinematic mechanism 50 for transforming the rotary motion of the drive shaft, and consequently of the propeller hub 2 constrained thereto, into the rotary motion of each of said blades 52 about their pivot axis to said propeller casing 3.

In more detail, said kinematic mechanism 50 determines rotation of the blades 52 about their pivot axis, thereby varying the angle of incidence with respect to the fluid (and therefore the fluid dynamic pitch) when the drive shaft, and consequently the hub 2, rotates in relation to the cylindrical propeller casing 3 by a non-zero rotation angle, or vice versa.

The kinematic mechanism 50 for transforming the rotary motion is, for example, of the type comprising a truncated-cone shaped gear pinion 54, integral with the root of each blade, that is, at the end of the blade housed inside the propeller casing 3.

The propeller hub 2 is provided with a gear wheel integral with a central truncated-cone shaped pinion 56, which permanently meshes the pinions 54 of the respective blades, so that rotation of the central pinion 56 with respect to the cylindrical propeller casing 3 determines corresponding rotation of the blades 52 about the respective pivot axes to the propeller casing 3, or vice versa.

This rotation of each blade 52 about its axis causes variation of the relative angle of incidence and therefore of the fluid dynamic pitch of the propeller.

Consequently, relative rotation of the drive shaft, or of the hub 2, with respect to the cylindrical propeller casing 3, determines rotation of the blades, according to an angle that is naturally a function of the angle of relative rotation between the hub 2 and the cylindrical propeller casing 3.

The kinematic mechanism described above can naturally be replaced with equivalent means which, by means of relative rotation between the drive shaft, and therefore the hub 2, and the cylindrical propeller casing 3, allow variation of the fluid dynamic pitch, transforming the rotation motion of the drive shaft into rotation of the blades about their pivot axis, and vice versa.

As can be seen in FIGS. 1 and 2, in the propeller of the assembly according to the present invention, the hub 2 rotates with respect to the cylindrical propeller casing 3, or vice versa, for at least a non-zero angular interval ($\alpha$) of operation of the kinematic mechanism for adjusting the fluid dynamic pitch, and the hub 2 also integral with at least one moving contact surface 20, 21 between at least one position of disengagement and at least one position of engagement, direct or indirect, with at least one relative abutment 10, 40, 41 integral with the cylindrical propeller casing 3 which defines at least one limit stop abutment of the angular interval ($\alpha$).

In other words, rotation of the hub 2 with respect to the cylindrical propeller casing 3 in a non-zero angular interval determines variation of the fluid dynamic pitch of the propeller blades by means of the aforesaid kinematic mechanism for transforming the relative rotary motion of the hub 2 with respect to the propeller casing 3, and vice versa, into rotation of each blade about its pivot axis to the cylindrical propeller casing 3.

More in detail, the hub 2 comprises, or is integral with, at least one contact surface 20 and 21 destined to reach at least one position of engagement with at least one abutment 10, 40, 41 which acts as limit stop for the angular interval of rotation of the hub 2 with respect to the propeller casing.

In the embodiment shown in the figures, the contact surfaces 20 and 21 of the hub 2 are positioned on a portion 22 of larger diameter of the hub 2, extending externally therefrom.

The hub 2 operated by the drive shaft can rotate freely with respect to the cylindrical propeller casing 3 until the at least one contact surface 20, 21 of the hub 2 reaches at least a position of engagement with at least one abutment 10, 40, 41, integral with the cylindrical propeller casing 3. Preferably, the angular interval of relative rotation between the hub 2 and the cylindrical propeller casing 3 is comprised between at least one of the contact surfaces 20 and 21 of the hub 2 and the relative abutment integral with the cylindrical propeller casing 3, which, as stated, acts as limit stop of the interval of rotation. In other words, the relative rotation between the hub 2 and the cylindrical propeller casing 3 is permitted until reaching the position of engagement of one of the contact surfaces 20 and 21 of the hub 2 with a relative abutment 10, 40, 41, integral with the cylindrical propeller casing 3.

As stated, in the embodiment shown in FIGS. 1 and 2, the hub 2 of the propeller is provided with a first and with a second contact surface 20 and 21, adapted to respectively reach a first position of engagement, direct or indirect, with a relative first limit stop abutment 40, integral with the cylindrical propeller casing 3, and a second position of engagement, direct or indirect, of the second contact surface 21 with a relative second limit stop abutment 41, integral with the cylindrical propeller casing 3. In this case, the angular interval ($\alpha$) of rotation of the hub 2 with respect to the cylindrical propeller casing 3 is defined by the first and by the second position of engagement.

It must be noted that the abutment integral with the cylindrical propeller casing, which acts as limit stop of the angular interval of rotation of the hub 2 with respect to the propeller casing 3, can comprise a surface 40, 41 of, or integral with, the cylindrical propeller casing 3 and or at least one screw 10, selected from the plurality of screws, which is installed inside at least one specific seat 30 provided in the propeller.

When no screws 10 are installed in the specific seats 30, the limit stop abutments comprise the abutment surfaces 40 and 41 provided in the cylindrical propeller casing 3 which, as said, are destined to reach a position of contact respectively with the contact surfaces 20 and 21 integral with the hub 2 following rotation of this latter with respect to the cylindrical propeller casing 3. The first contact surface 20 of the hub 2 is destined to reach the position of engagement with the abutment surface 40 when the drive shaft, and consequently the propeller hub 2, is driven in rotation in counter-clockwise direction.

On the contrary, when the direction of rotation of the engine is inverted, according to the clockwise direction, the contact surface 21 of the hub 2 reaches the position of engagement with the abutment surface 40 integral with the cylindrical propeller casing 3.

Reaching of the position of engagement of the hub 2 with the cylindrical propeller casing 3, and in particular of one of the contact surfaces 20 and 21 with the relative abutment, determines positioning of the blades, by means of the aforesaid kinematic mechanism for transmission of motion, at a predetermined fluid dynamic pitch.

The angular rotation space (angle $\alpha$) of the hub with respect to the cylindrical propeller casing can be adjusted by means of the screws 10 which are installed completely, by complete screwing, in the specific seats 30 provided in the propeller. As stated, the limit stop abutment of the angular interval comprises at least one region of at least one screw 10 installed in the seat 30 provided in the propeller. The region of the screw 10 acts as abutment for the contact surface 20, 21 of the hub 2, modifying the limit stop of the angular interval of rotation of the hub with respect to the cylindrical propeller casing, and vice versa. In fact, once the screw is installed in the specific seat 30 it acts as abutment for the hub 2, and in particular for at least one of the contact surfaces 20, 21 thereof, which reach at least a position of contact with a region of the screw 10.

According to a preferred embodiment, the region of the screw that acts as limit stop abutment of the angular interval of rotation is the end of the screw.

As will be clear at this point of the description, depending on the length of the screw 10 installed in the specific seat 30, it is possible to obtain a modification of the angular interval of relative rotation of the hub with respect to the propeller casing, and in particular a modification of the limit stop of this angular interval.

In fact, depending on the length of the screw 10 installed, the at least one contact surface 20, 21 integral with the hub 2 will reach the position of engagement with the relative abutment, that is, at least one region of the screw 10 and preferably the end thereof, following rotation of the hub with respect to the cylindrical propeller casing, or vice versa, in an angular interval of different dimensions in relation to the modification of the limit stop of this angular interval by means of the length of the screw 10.

FIGS. 1 and 2 show the angular variation (δ) due to installation of screws 10 of different length, which represents the modification of the limit stop abutment of the angular interval of rotation of the hub 2 with respect to the cylindrical propeller casing 3, and vice versa, which comprises at least one region of the screw, and preferably the end of the screw 10 installed in the seat 30.

Advantageously, the assembly according to the present invention comprises a plurality of calibrated screws 10, having different configurations, with which the user of the propeller is provided, which are installed alternatively in the specific seats 30 of the propeller. The screws installed in the specific seats 30 form the abutment for the hub 2, and in particular for the surfaces 20 and 21, in such a manner that the limit stop of the angular interval can be easily modified by the user simply by installing a different screw 10 in the specific seat 30.

According to one aspect of the present invention, each screw has at least one stem 11 having a different length with respect to that of the other screws, and according to a further possible embodiment, the plurality of screws comprises pairs of screws having a stem of identical length, and each pair has a different length of stem with respect to that of the other pairs of screws.

Naturally, the plurality of screws 10 can comprise a variable number of screws, depending on the adjustment requirements of the user of the propeller and which can be integrated by requesting further screws 10 of different lengths from the manufacturer of the propeller, in the case in which the blades require to be positioned at different fluid dynamic pitches, for example following replacement of the motor to which the propeller is coupled.

The user will therefore be provided with a plurality of screws 10 having a different length to allow accurate adjustment of the fluid dynamic pitch of the blades by installing the screw in the specific seat and determining a modification of the limit stop of the angular interval of rotation of the hub with respect to the cylindrical casing, and vice versa, in relation to the length of the screw.

It must be noted that each stem length of the screw corresponds to a given fluid dynamic pitch of the blades, which is established in the design phase by the manufacturer of the propeller, and therefore by selecting the screw from the plurality of screws provided, the user has the certainty of setting the required fluid dynamic pitch of the blades.

Preferably, the screws are installed completely inside the specific seat provided in the propeller, and reach a position of contact with at least one abutment portion 31 of the seat 30. In other words, the screws 10 are screwed completely inside the seat 30 in the propeller.

In this way, the user inserts the screw 10 inside the seat 30 until reaching the position of contact with the abutment portion 31 of the seat, in such a manner that the screw reaches a certain and unequivocal position inside the seat 30, and which can therefore determine modification of the limit stop of the angular interval of rotation of the predetermined amplitude.

As already stated, it must be noted that the term "screw" is used herein to indicate any element, such as rods, pins, bolts, provided with at least one stem 11 having a predetermined length and provided with at least one portion, or one head 12 adapted to reach at least one position of contact with at least one abutment portion 31 of the seat 30 inside which the screw is installed.

According to a possible embodiment, each screw 10 is provided with at least one portion, or one head 12, bearing a thread capable of cooperating with a corresponding threaded portion of the seat 30 provided in the propeller.

More in detail, as can be seen in FIGS. 1 and 2, the seat 30 comprises an abutment portion 31, destined to contact, preferably, the lower surface 13 of the head 12 of the screw 10. Consequently, the screw 10 is screwed into the seat 30 until the lower surface 13 of the head 12 reaches the contact portion with the surface 31 of the seat 30.

It must also be noted that the screws 10 are provided with an appropriately shaped portion adapted to be engaged by a tool, or also manually, by the user, to allow installation thereof in the seat 30 provided in the propeller. Preferably, the head of the screw is provided with a hexagonal operating portion, or similar, adapted to be engaged temporarily by a tool having a complementary shape which allows the user to screw or unscrew the screw 10 in the specific seat 30.

In the embodiment shown in the figures, the seat 30 inside which at least one screw 10 is installed passes inside the cylindrical casing 3, in such a manner that at least part of the screw 10, and in particular the stem 11 thereof, projects at least partly inside the cylindrical propeller casing 3 to act as limit stop abutment for the hub 2 and consequently adjust the angle of rotation of the hub with respect to the cylindrical propeller casing, and vice versa. In the embodiment shown in the figures, the seat 30 has a cylindrical shape and is provided with a portion 30.1 with smaller diameter destined to allow passage of the stem 11 of the screw 10 therein, and a second portion 30.2 with larger diameter with respect to that of the portion 30.1, which is destined to receive the head 12 of the screw 10. The difference in diameter between the first and the second portion 30.1 and 30.2 of the seat 30 determines the formation of the abutment surface 31, destined to come into contact with the lower surface 13 of the head 12 of the screw 10.

Naturally, other embodiments of the seat can be produced, provided that the seat allows one or more screws 10, installed therein, to be made integral with the propeller and in particular with the cylindrical propeller casing 3.

Preferably, the seat 30 is produced in the propeller, and in particular in the cylindrical casing 3 thereof, in such a manner that the screw 10 installed therein is substantially perpendicular with respect to a plane passing through the axis A of rotation of the hub 2.

As stated, in the embodiment shown in the accompanying FIGS. 1 and 2, the hub 2 is provided with two contact surfaces 20 and 21 with a relative abutment which acts as limit stop of the angular interval of relative rotation between these two elements of the propeller. According to this embodiment, the propeller is provided with two seats 30 for installation, inside each of these, of at least one screw 10 selected by the user from the plurality of screws provided.

In this way, it is possible to separately adjust the fluid dynamic pitch of the blades in the case in which the hub 2 is operated by the drive shaft, to which it is connected, in clockwise or counter-clockwise direction, generally used to allow navigation in forward drive and in reverse drive.

In fact, the possibility of separately inserting two screws 10 into the specific seats 30 for modification of the limit stop, respectively for rotation of the hub in clockwise and counter-clockwise directions, allows separate adjustment of the fluid dynamic pitch of the blades for the two navigation modes.

The assembly according to the present invention for this purpose allows installation in the two seats 30 of the propeller of screws 10 having identical length, in such a manner as to be able to set, in an extremely accurate manner, the pitch of the blades for both directions of rotation of the hub with respect to the cylindrical casing, and vice versa, due to the identical modification of the limit stop of the angular interval.

Adjustment of pitch both for forward drive and for reverse drive corresponding to the same fluid dynamic pitch of the blades is very difficult to obtain in prior art propellers, such as the one described in DE3901672, in which the user must rotate both grub screws by the same degree, so that the angle of rotation of the hub with respect to the propeller casing is modified by the same degree for both directions of rotation of the hub, clockwise and counter-clockwise.

On the contrary, using the assembly according to the present invention, the pitch of the propeller can be easily adjusted with extreme precision, and in particular by means of the pairs of screws 10 having the stem 11 of identical length, the user can obtain an identical modification of the limit stop of the angular interval of rotation of the hub with respect to the cylindrical casing 3, and vice versa.

As already stated, simultaneous adjustment of the limit stop of the angular interval of rotation of the hub with respect to the cylindrical casing, and vice versa, is particularly advantageous in the case in which the propeller blades are provided with symmetrical profile and consequently require to be positioned at the same fluid dynamic pitch both for navigation in forward drive and in reverse drive.

As can be seen in FIG. 1, the propeller of the assembly according to the invention also comprises anti-loosening safety means 50 to prevent unwanted removal of the screw 10 from the corresponding seat 30 in which it is installed. As shown in FIG. 1, these means 50 preferably comprise one or more threaded grub screws 51 which are positioned in proximity of the seat 30 and installed in specific threaded holes 52 provided in the propeller. The safety grub screws 51 are positioned in such a manner as to prevent accidental loosening of the screws 10, which can be caused by rotation of the propeller during its operation, and are generally positioned with axis substantially perpendicular with respect to the axis of the screw 10, or of its direction of movement during installation in/removal from the seat 30.

According to a further possible embodiment, the assembly according to the present invention also comprises a plurality of calibrated rods 15 which can be installed alternatively between the hub 2 and the cylindrical propeller casing 3, and in particular, between at least one contact surface 20, 21 of the hub and the relative abutment 10, 40, 41 integral with the cylindrical casing 3, inside the angular interval ($\alpha$) of relative rotation of the hub with respect to the cylindrical propeller casing, or vice versa, to perform adjustment thereof.

Naturally, depending on the thickness of the rod 15 installed, it is possible to vary, to a different degree, the angular interval of rotation, allowing a different modification of the fluid dynamic pitch of the blades.

FIG. 2 indicates the thickness (dimension) of the rods 15, equal to the angle $\gamma$, by which the angle of relative rotation of the hub 2, and in particular of its contact surfaces 20 and 21, is reduced to reach the position of engagement with the relative abutment 10, 40, 41 integral with the cylindrical propeller casing 3.

The angle of rotation of the hub 2 with respect to the propeller casing 3 can be modified by increasing or decreasing the angle $\gamma$ equal to the dimension (thickness) of the calibrated rod or rods 15 installed.

According to possible embodiments of the assembly, each rod 15 has a different thickness with respect to that of the other rods 15, or the plurality of rods comprises pairs of rods having identical thickness, each pair having a different thickness with respect to that of the other pairs of rods 15.

Two or more rods 15, preferably having identical thickness, can be provided mutually constrained to form a single piece, not shown in the accompanying figures, substantially having the shape of a fork.

This particular configuration allows simultaneous installation of two rods 15 between the first contact surface 20 of the hub 2 and the relative abutment 40, and the second contact surface 21 and the relative abutment 41 (see FIG. 2).

In this manner, the operations to modify the pitch both for rotation of the hub in a clockwise and in counter-clockwise direction are considerably simplified; in fact, the user simply requires to replace the fork comprising two rods 15 having identical thickness to obtain, with extreme accuracy, the same fluid dynamic pitch of the blades for both directions of rotation of the hub with respect to the cylindrical propeller casing, and vice versa.

Naturally, the rods 15, mutually constrained to form a single piece, can also have a different thickness (dimension).

There shall now be described the steps of the method for adjusting the fluid dynamic pitch of the blades in the assembly according to the present invention.

As stated, the fluid dynamic pitch of the blades is adjusted by means of a plurality of screws 10 which are installed alternatively in the propeller in such a manner as to modify, in an accurate and precise manner, the angular interval of rotation of the hub 2 with respect to the cylindrical propeller casing 3, and vice versa, modifying the position of the limit stop of said angular interval.

In other words, as a function of the length of the screws 10, the hub 2, and in particular, a contact surface 20, 21 thereof, will reach the position of engagement with the abutment, preferably formed by one end of the screw 10, modifying the angular interval of rotation of the hub 2 with respect to the cylindrical propeller casing 3, and consequently the fluid dynamic pitch of the blades.

Advantageously, the assembly according to the present invention comprises a plurality of calibrated screws 10 having a stem 11 of different length to one another. The length of the stem corresponds to a predetermined angular modification of the fluid dynamic pitch.

The method for adjusting the fluid dynamic pitch of the blades consists of the step of selecting, from the plurality of screws 10 provided, at least one screw 10 configured to define a required angular interval (α) of relative rotation of the hub 2 with respect to the cylindrical propeller casing 3, or vice versa; a subsequent step of installing the screw or screws 10 selected in the corresponding seat 30 provided in the propeller; and the step of replacing the screw installed in the seat 30 with a different screw selected in the plurality of screws 10, when requiring to modify the angular interval (α) of relative rotation of the hub 2 with respect to the cylindrical propeller casing 3, or vice versa.

As already stated, the user of the assembly according to the present invention is provided with a plurality of screws having different length which, installed in the specific seat 30, allow a modification of the angular interval of relative rotation of the hub with respect to the propeller casing and, in particular, a modification of the limit stop of this angular interval.

In fact, depending on the length of the screw installed, the at least one contact surface 20, 21 integral with the hub 2 will reach the position of engagement with the relative abutment, that is, at least one region of the screw 10 and preferably the end thereof, following a rotation with respect to the cylindrical propeller casing, or vice versa, in an angular interval of different dimensions in relation to the modification of the limit stop of this angular interval by means of the length of the screw 10.

Consequently, installation of the screw 10 selected in the seat 30, until reaching the position of contact with the abutment portion 31 of the seat 30, will allow positioning of the blades at the required fluid dynamic pitch following the modification of the limit stop of the angular interval of rotation of the hub 2 with respect to the propeller casing 3.

In fact, depending on the length of the screw 10 installed in the seat 30, the contact surface or surfaces 20 and 21 of the hub 2 will reach the position of engagement with the relative abutment, that is, a region of the screw 10 and preferably the end thereof, following rotation in an angular interval of dimensions established by the length of the screw 10, which acts as limit stop of the angular interval.

The same operations described above in relation to the plurality of screws 10 the user of the propeller is provided with can also be carried out to modify the pitch of the blades by selecting and installing one or more rods 15 inside the angular interval between at least one contact surface of the hub 2 and the relative limit stop abutment 10, 40, 41, integral with the cylindrical propeller casing 3.

In particular, the method for adjusting the pitch according to the present invention can comprise the steps of selecting from the plurality of rods 15 provided, at least one rod 15 corresponding to the adjustment of the angular interval (α) of relative rotation of the hub 2 with respect to the cylindrical propeller casing 3, or vice versa, corresponding to the required rotation of the blades; installing the at least one rod 15 selected from at least one contact surface 20, 21 of the hub 2 and the at least one relative abutment 10, 40, 41, integral with the cylindrical casing 3, inside the angular interval of relative rotation of the hub 2 with respect to the cylindrical propeller casing 3, to perform adjustment thereof.

The method comprises the further step of removing the rod or rods 15 installed and of selecting and installing at least another rod 15 to modify the angular interval of relative rotation of the hub 2 with respect to the cylindrical propeller casing 3, and vice versa.

It must be noted that the rod or rods 15 can be used to adjust the angular interval both when the screws 10 are installed in the specific seat, and when the user has not installed any screw 10 inside the specific seat 30 in the propeller.

In the case in which a screw 10 has been installed in the specific seat 30, the resulting adjustment of the fluid dynamic pitch of the blades will depend on the length of the screw 10 and on the thickness of the rod or rods 15 installed between the contact surfaces 20 and 21 of the hub 2 and the relative abutment, which corresponds, preferably, to one end of the screw 10.

Alternatively, it is possible to install one or more rods 15 without any screw 10 being installed in the specific seat 30. In this case, the limit stop abutment of the angular interval is formed by a surface 40, 41 integral with the propeller casing 3 and the resulting modification of the fluid dynamic pitch of the blades will be given by the thickness of the rod or rods 15 interposed between a contact surface 20 and 21 of the hub 2 and the relative abutment of the cylindrical propeller casing, which in this case corresponds to the surfaces 40 and 41 integral with the cylindrical casing 3.

It must be noted that the variation of the angular interval of rotation that can be obtained by means of the screws 10 is very precise, but may be limited in the case in which it is necessary to perform wide variations (in the order of tens of degrees) of the fluid dynamic pitch, and consequently of the angular interval of rotation of the hub 2 with respect to the propeller casing 3, and vice versa.

If it is necessary to extend or move the field of adjustment of the angular interval, it is possible to use the plurality of rods 15, by means of which wider variations of the angular interval can be obtained.

Finally, it must be noted that the propeller of the assembly according to the present invention can also be provided with at least one elastic element for continuous variation of the fluid dynamic pitch of the blades during the relative rotation of the hub 2 with respect to the cylindrical propeller casing 3, and vice versa, in the angular interval of rotation, for example as described in the patent application WO2008/075187, also in the name of the Applicant.

The invention claimed is:

1. An assembly comprising a plurality of screws and a propeller provided with at least one blade pivoted rotatably to a cylindrical propeller casing, a hub coupled to an engine and mounted coaxially inside said propeller casing, a kinematic mechanism coupled to said hub, and/or to said propeller casing, and to said at least one blade for adjusting the fluid dynamic pitch of the propeller by means of rotation of said at least one blade about its pivot axis to said propeller casing, said hub being rotatable with respect to said cylindrical propeller casing, or vice versa, for at least one non-zero angular interval (α) of operation of said kinematic mechanism for adjusting the fluid dynamic pitch, said hub being integral with at least one contact surface that is movable between at least one position of disengagement from and at least one position of engagement, direct or indirect, with at least one relative abutment integral with said cylindrical propeller casing, said at least one relative abutment defining at least one limit stop of said at least one angular interval (α), wherein said plurality of screws comprises at least two different screws and said propeller comprises at least one seat for complete installation of at least one screw selected from said plurality of screws, said at least one limit stop abutment comprising at least one region of said at least one screw selected from said plurality of screws and installed completely in said seat, and wherein each screw has at least one stem having a different length with respect to that of the other screws.

2. The assembly according to claim 1, wherein said at least one region of said screw that acts as at least one limit stop abutment of said at least one angular interval (α) comprises at least the end of said at least one screw.

3. The assembly according to any one of claim 1, wherein said plurality of screws comprises pairs of screws having a stem of identical length, each pair having a stem of different length with respect to that of the other pairs of screws.

4. The assembly according to claim 1, wherein each screw of said plurality of screws comprises a clamping head adapted to reach a position of contact with at least one abutment portion of said seat of said cylindrical casing of the propeller.

5. The assembly according to claim 1, wherein said at least one limit stop abutment comprises a relative first and second limit stop abutment, and said at least one contact surface comprises a first and a second contact surface, integral with said hub, said hub being rotatable with respect to said cylindrical propeller casing between a first position of engagement, direct or indirect, of said first contact surface with said relative first limit stop abutment, integral with said cylindrical propeller casing, and a second position of engagement, direct or indirect, of said second contact surface with said relative second limit stop abutment, integral with said cylindrical propeller casing, said angular interval (α) of rotation of said hub with respect to said cylindrical propeller casing being defined by said first and second position of engagement.

6. The assembly according to claim 1, wherein said at least one seat comprises two seats for installation, inside each of said two seats, of at least one screw selected from said plurality of screws.

7. The assembly according to claim 1, wherein said at least one seat is produced in said propeller in such a manner that the screw installed therein is substantially perpendicular with respect to a plane passing through the axis (A) of rotation of said hub.

8. The assembly according to claim 1, wherein it comprises a plurality of calibrated rods which can be inserted alternatively between said at least one contact surface of said hub and said at least one relative abutment integral with said cylindrical casing, inside said angular interval (α) of relative rotation of said hub with respect to said cylindrical propeller casing, or vice versa, to perform adjustment thereof.

9. The assembly according to claim 8, wherein each rod has a different thickness with respect to that of the other rods.

10. The assembly according to claim 8, wherein said plurality of rods comprises pairs of rods having identical thickness, each pair having a different thickness with respect to that of the other pairs of rods.

11. The assembly according to claim 10, wherein said rods of each pair having identical thickness are mutually constrained to form a single piece.

12. The assembly according to claim 1, wherein it comprises anti-loosening safety means to prevent unwanted removal of said screw from the corresponding seat in which it is installed.

13. A method for adjusting the fluid dynamic pitch of a propeller by means of an assembly according to claim 1, comprising the steps of:

a) selecting, from said plurality of screws, at least one screw configured to define a required angular interval (α) of relative rotation of said hub with respect to said cylindrical propeller casing, or vice versa;

b) installing said at least one screw selected in step a) in the corresponding seat provided in the propeller; and c) replacing said screw installed in said seat with a different screw selected from said plurality of screws, when it is necessary to modify said angular interval (α) of relative rotation of said hub with respect to said cylindrical propeller casing, or vice versa.

14. The method according to claim 13, comprising the further steps of:

d) selecting from a plurality of rods provided, at least one rod corresponding to the adjustment of said angular interval (α) of relative rotation of said hub with respect to said cylindrical propeller casing, or vice versa, corresponding to the required rotation of the blades;

e) installing said at least one rod selected in step a) between said at least one contact surface of said hub and said at least one relative abutment integral with said cylindrical casing inside said angular interval of relative rotation of said hub with respect to said cylindrical propeller casing; to perform adjustment thereof.

15. The method according to claim 14, comprising the further step of removing said at least one rod installed and repeating steps d) and e) to select and install at least another rod from the plurality of rods provided to modify said angular interval of relative rotation of the hub with respect to the cylindrical propeller casing, and vice versa.

* * * * *